US007010998B2

(12) United States Patent
Ying-Hao

(10) Patent No.: US 7,010,998 B2
(45) Date of Patent: Mar. 14, 2006

(54) SOCKETS AND METHOD OF SURFACE TREATMENT FOR SOCKETS

(76) Inventor: Peng Ying-Hao, No.84, Daming 1rd Rd., Dong-bao Village, Tanzih Township, Taichung County 427 (TW)

( * ) Notice: Subject to any disclaimer, the term of this patent is extended or adjusted under 35 U.S.C. 154(b) by 181 days.

(21) Appl. No.: 10/694,662

(22) Filed: Oct. 28, 2003

(65) Prior Publication Data

US 2004/0144214 A1 Jul. 29, 2004

(30) Foreign Application Priority Data

Jan. 24, 2003 (TW) ..... 92101765 A

(51) Int. Cl.
*B25B 13/06* (2006.01)

(52) U.S. Cl. ..... 81/121.1; 81/DIG. 5
(58) Field of Classification Search ..... 81/119, 81/121.1, 125, 124.2, 124.4, DIG. 5
See application file for complete search history.

(56) References Cited

U.S. PATENT DOCUMENTS

| | | | | |
|---|---|---|---|---|
| 6,047,618 | A * | 4/2000 | Pieri | 81/121.1 |
| 6,257,098 | B1 * | 7/2001 | Cirone | 81/119 |
| 6,465,114 | B1 * | 10/2002 | Honda et al. | 428/659 |
| 6,761,093 | B1 * | 7/2004 | Chang | 81/121.1 |
| 2001/0001892 | A1 * | 5/2001 | Hu | 29/527.2 |

* cited by examiner

*Primary Examiner*—Jacob K. Ackun, Jr.
(74) *Attorney, Agent, or Firm*—Alan D. Kamrath; Nikolai & Mersereau, P.A.

(57) ABSTRACT

A socket has a dark colored outer surface and a specification rolled in the outer surface of the socket and coated with a brighter colored electroplating. The method for the surface treatment of the socket includes rolling the specification in an outer surface of the socket; electroplating the socket with a light colored layer of electroplating; removing the light colored layer of electroplating from the outer surface of the socket except for the specification and coating a dark colored layer on the outer surface of the large section except for the specification. By the surface treatment, the specification is obvious from the dark colored outer surface of the socket.

3 Claims, 7 Drawing Sheets

SOCKETS AND METHOD OF SURFACE TREATMENT FOR SOCKETS

FIELD OF THE INVENTION

The present invention relates to a socket and a method of surface treatment for sockets. The specification is rolled in the surface and displayed in a light-colored layer of electroplating, and the rest of the surface of the socket is displayed in black.

BACKGROUND OF THE INVENTION

A conventional socket 50 is shown in FIG. 7 and generally includes a large section 52 and a small section 51. A passage 53 is defined through the socket 50. The specification 54 is rolled in the outer surface of the large section 52. The whole socket 50 is proceeded with electroplating such that a light-colored layer of electroplating 60 is coated to the inner surface and outer surface side of the socket 50. Nevertheless, the specification 54 is not obvious, because there is no difference between the color of the specification 54 and the outer surface of the socket 50. Another surface treatment is to merge the socket in a solution of Manganese Phosphit, and this makes the surface dark. The inherent shortcoming of the above mentioned problem is not improved. Some of the specification 54 is printed on the outer surface of the socket 50. Although different colors can be used to the specification 54, it tends to be worn out.

The present invention intends to provide a method for making the specification of the socket brighter than the color of the outer surface of the socket so that the specification can be seen clearly.

SUMMARY OF THE INVENTION

The present invention relates to a socket and a method for surface treatment of a socket. The method comprises a step of rolling a specification in an outer surface of the large section; a step of electroplating the socket with a light colored layer of electroplating; a step of removing the light colored layer of electroplating from the outer surface of the large sections; and a step of coating a dark colored layer on the outer surface of the large section but with the specification being excluded.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
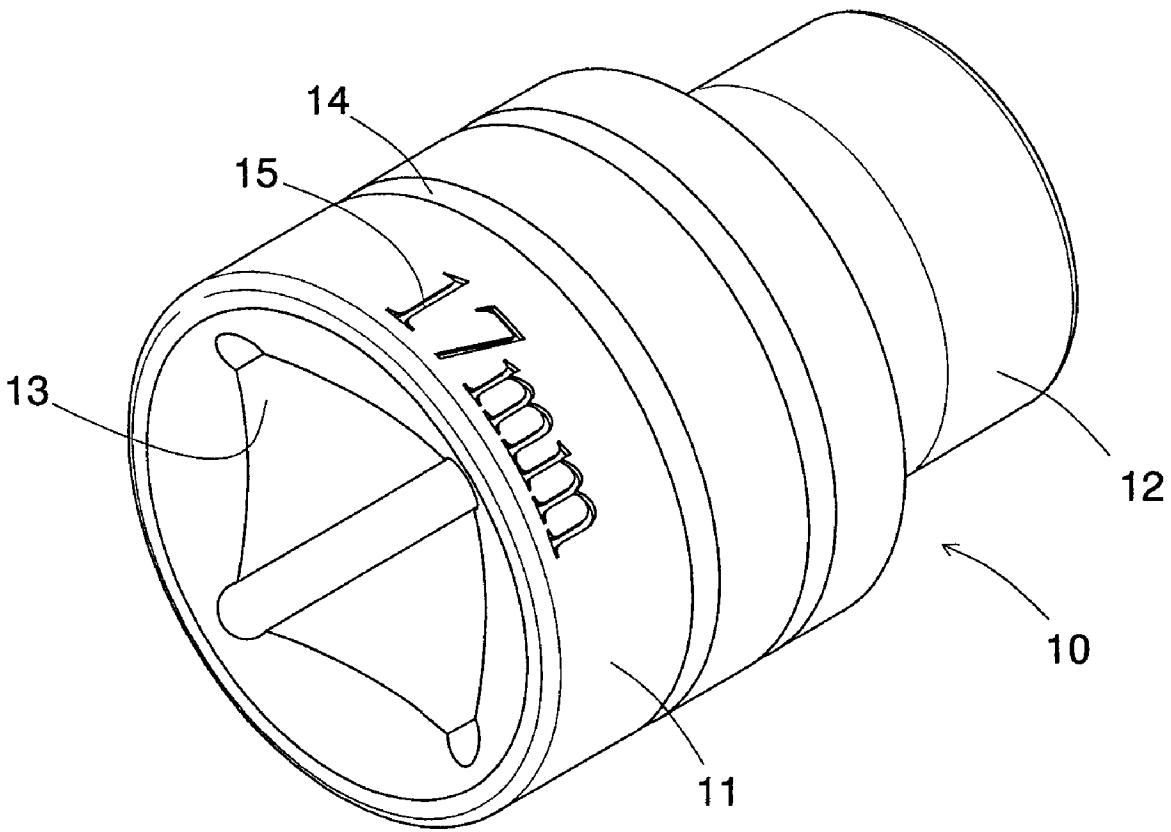
FIG. 1 is a perspective view to show the socket of the present invention.
Figure 2:
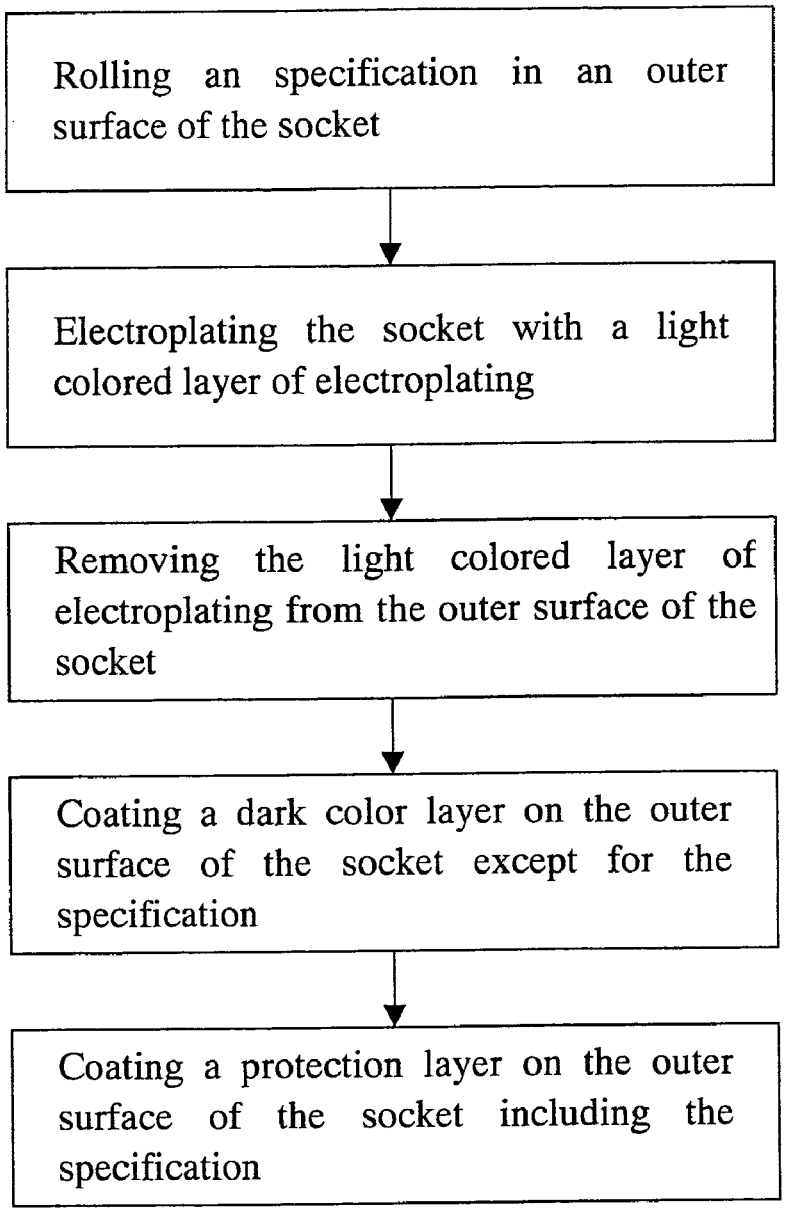
FIG. 2 shows the flow chart of the method of the present invention.

Referring to FIGS. 1 and 2, the socket 10 of the present invention comprises a body having a large section 11 and a small section 12. A passage 13 is defined through the body, and two grooves 14 are defined in an outer periphery of the large section 11. An outer surface of the large section 11 is a dark colored surface, and a specification 15 rolled in the outer surface of the large section 11 is coated with a brighter colored electroplating, such that the specification 15 can be seen clearly.

Figure 3:
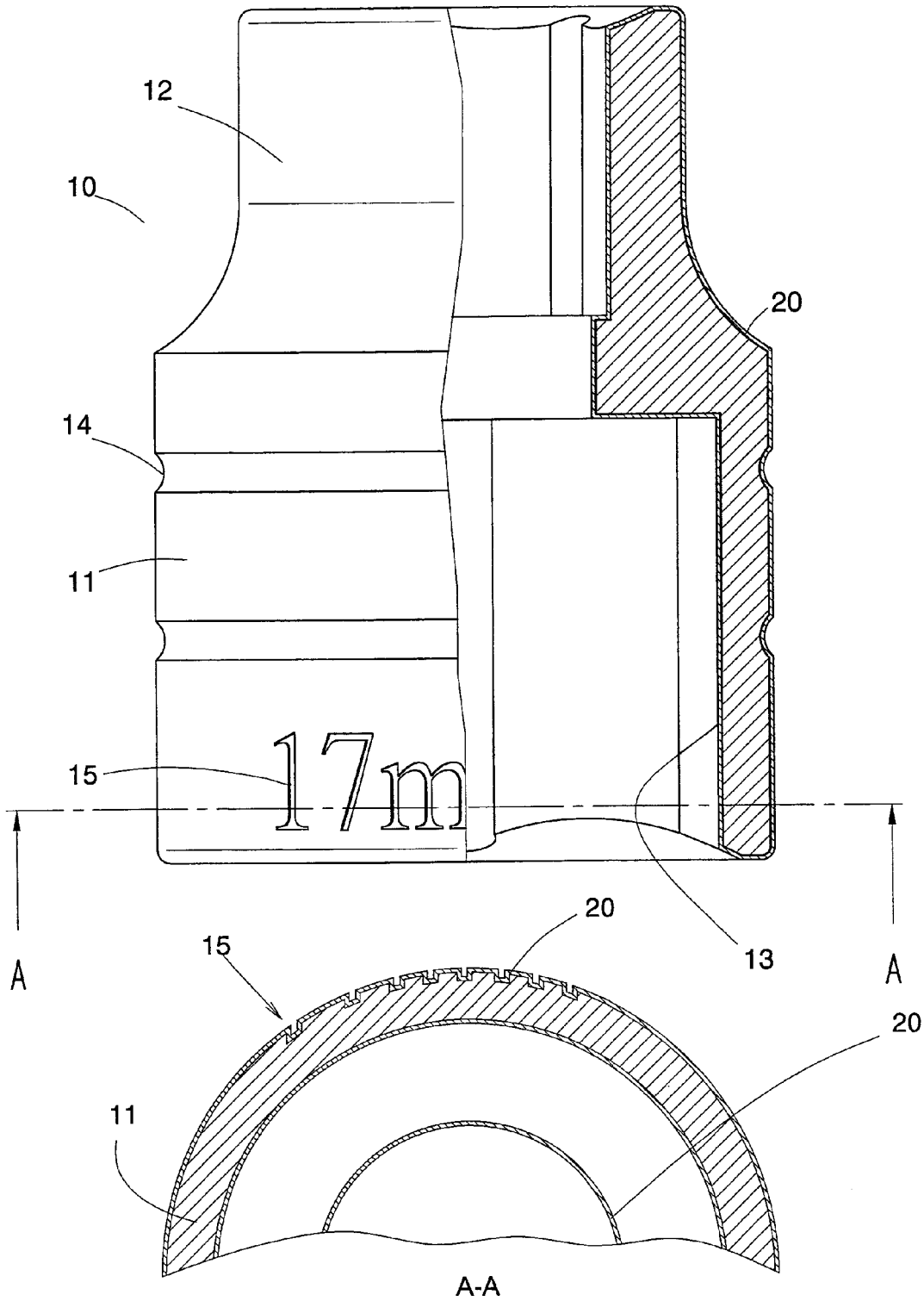
FIG. 3 is a cross sectional view to show a layer of electroplating coated to the socket.
Figure 4:
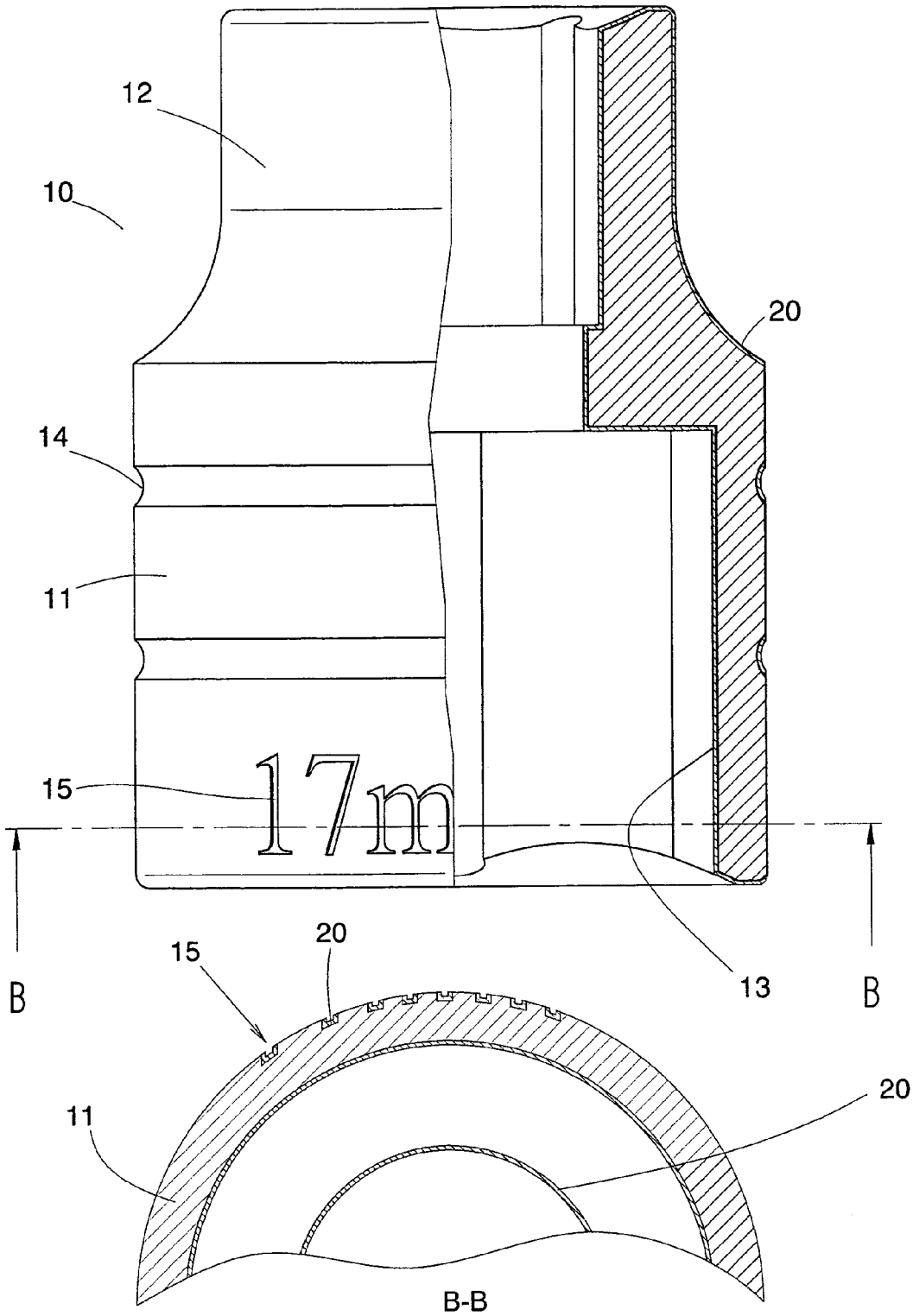
FIG. 4 is a cross sectional view to show the layer of electroplating removed from the outer surface of the large section of the socket.
Figure 5:
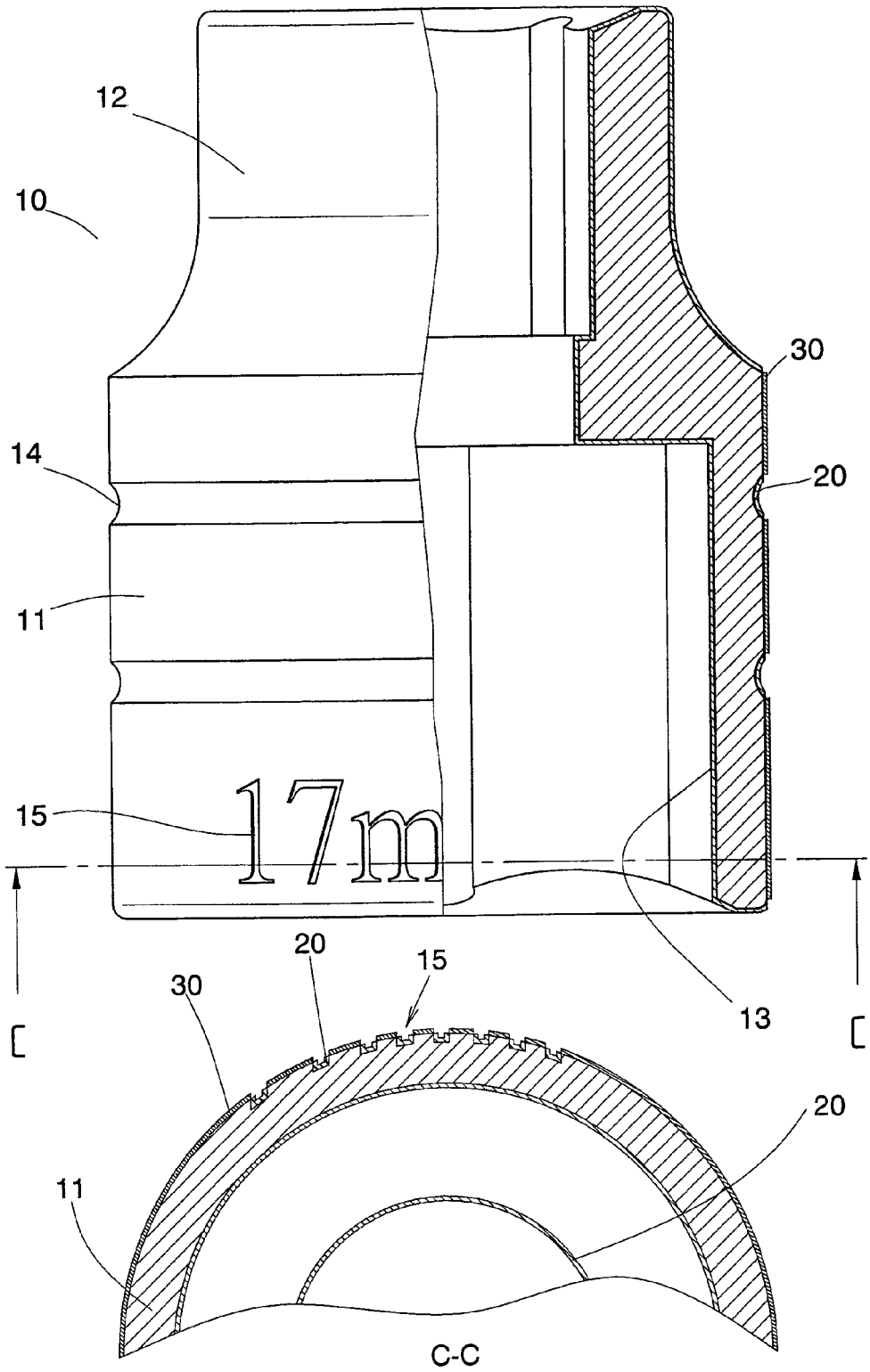
FIG. 5 is a cross sectional view to show that a dark layer coated on the outer surface of the large section of the socket.
Figure 6:
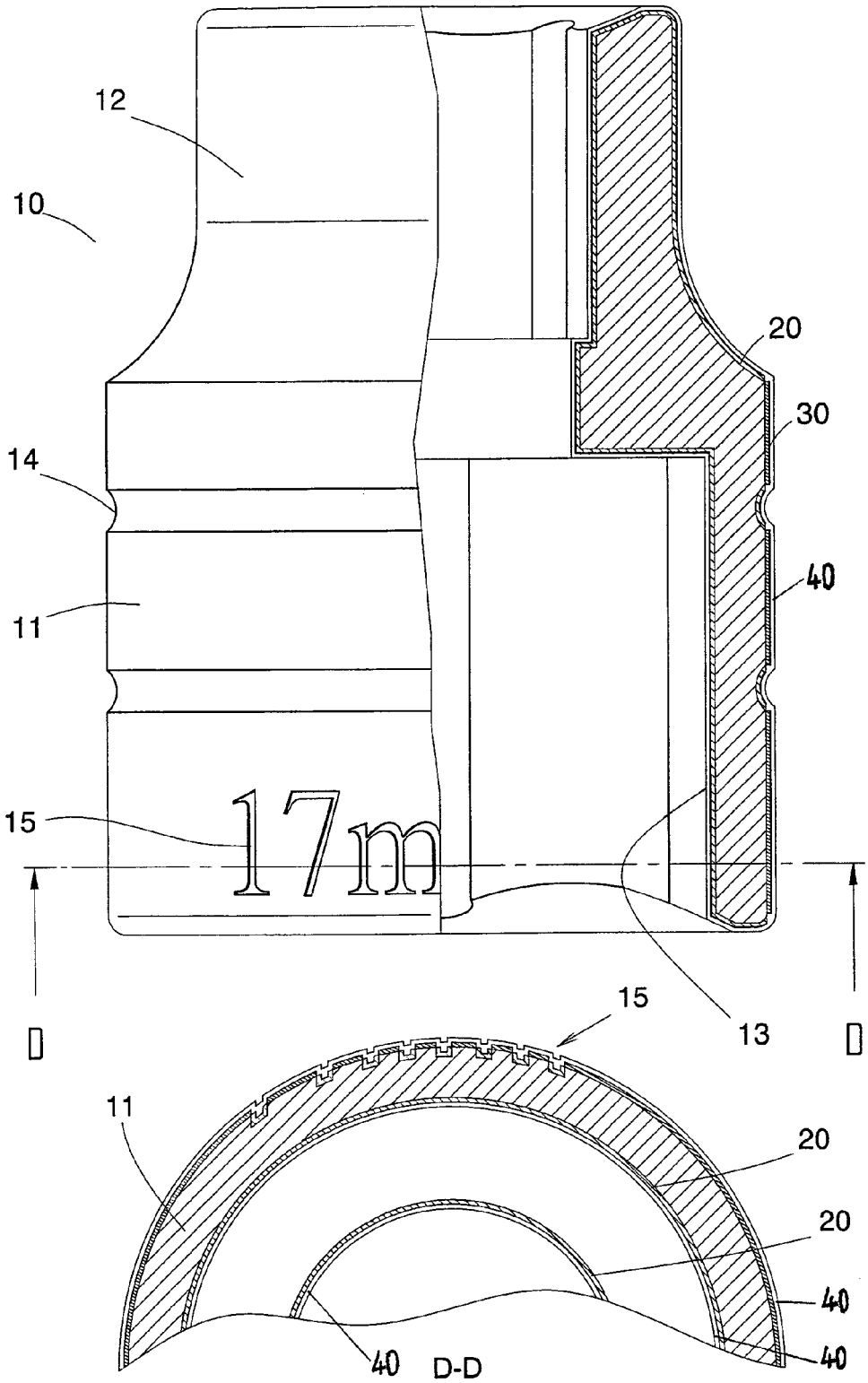
FIG. 6 shows a protection layer coated on the dark layer on the large section of the socket.
Figure 7:
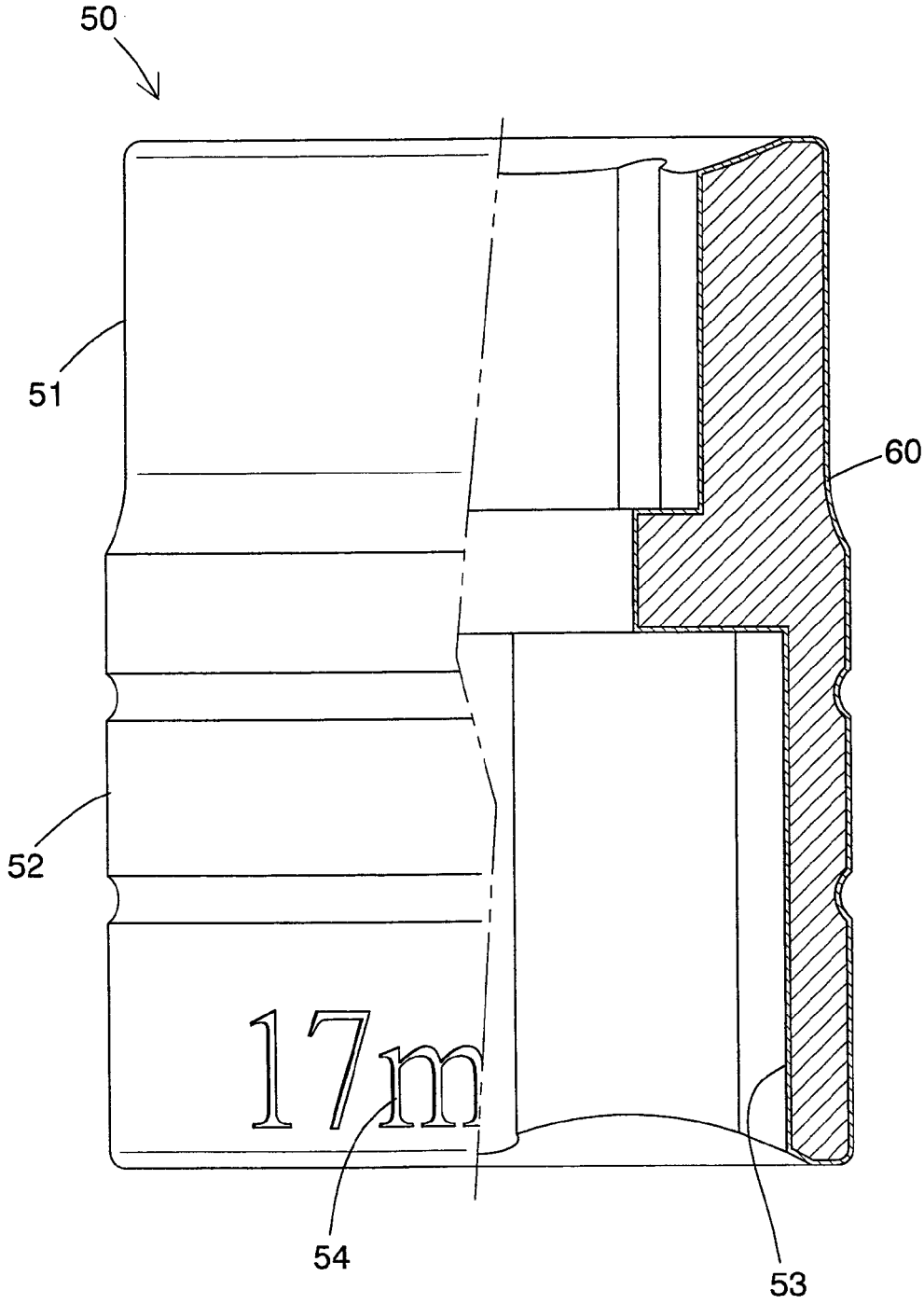
Fig7 PRIOR ART
FIG. 7 is a cross sectional view of a conventional socket.

A method for making the light colored specification 15 in the outer surface of a socket 10 includes:

a step of rolling the specification 15 in the outer surface of the large section 11;

a step of electroplating the socket 10 with a light colored layer of electroplating 20 as shown in FIG. 3;

a step of removing the light colored layer of electroplating 20 from the outer surface of the large section 11 as shown in FIG. 4;

a step of coating a dark colored layer 30 on the outer surface of the large section 11 by immerging the socket 10 into a solution of Manganese Phosphite while the specification 15 is separated from the solution, as shown in FIG. 5, and a step of coating a protection layer 40 on the outer surface of the large section 11 and the specification 15 as shown in FIG. 6.

By the surface treatment, the bright light colored specification 15 of the socket 10 is obvious from the dark colored layer 30 of the large section 11 of the socket 10.

While we have shown and described the embodiment in accordance with the present invention, it should be clear to those skilled in the art that further embodiments may be made without departing from the scope of the present invention.

What is claimed is:

1. A method for surface treatment of a socket, the method comprising: rolling a specification in an outer surface of the socket; after rolling the specification, electroplating the socket with a light colored layer of electroplating; removing the light colored layer of electroplating from the outer surface of the socket except for the specification; and after removing the light colored layer, coating a dark colored layer on the outer surface of the socket except for the specification.

2. The method as claimed in claim 1 further comprising coating a protection layer on the outer surface of the socket including the specification after coating the dark colored layer.

3. The method as claimed in claim 1, wherein coating the dark colored layer comprises immerging the socket into a solution of Manganese Phosphite.

* * * * *